US009249555B2

(12) United States Patent
Reedy et al.

(10) Patent No.: US 9,249,555 B2
(45) Date of Patent: Feb. 2, 2016

(54) HYDRAULIC SYSTEM HAVING FIXABLE MULTI-ACTUATOR RELATIONSHIP

(75) Inventors: John T. Reedy, Peoria, IL (US); Robert E. Stone, Metamora, IL (US)

(73) Assignee: Caterpillar Inc., Peoria, IL (US)

( * ) Notice: Subject to any disclaimer, the term of this patent is extended or adjusted under 35 U.S.C. 154(b) by 1216 days.

(21) Appl. No.: 13/080,421

(22) Filed: Apr. 5, 2011

(65) Prior Publication Data

US 2012/0255293 A1 Oct. 11, 2012

(51) Int. Cl.
*E02F 3/43* (2006.01)
*E02F 9/22* (2006.01)

(52) U.S. Cl.
CPC ..... *E02F 3/432* (2013.01); *E02F 3/436* (2013.01); *E02F 9/2228* (2013.01); *E02F 9/2296* (2013.01)

(58) Field of Classification Search
CPC ..... E02F 9/22; E02F 9/2203; E02F 9/2221; F15B 21/08221; F15B 21/082; F15B 21/087; F15B 2211/3057; F15B 2211/30575; F15B 2211/6336; F15B 2211/6346; F15B 2211/6658; F15B 2211/88; F15B 11/162; F15B 11/006
USPC ..... 60/422, 426, 459, 427
See application file for complete search history.

(56) References Cited

U.S. PATENT DOCUMENTS

| | | | | | |
|---|---|---|---|---|---|
| 4,964,779 | A * | 10/1990 | Sagaser | ..... | 414/708 |
| 5,160,239 | A * | 11/1992 | Allen et al. | ..... | 414/699 |
| 6,185,493 | B1 * | 2/2001 | Skinner et al. | ..... | 701/50 |
| 6,233,511 | B1 * | 5/2001 | Berger et al. | ..... | 701/50 |
| 6,282,453 | B1 * | 8/2001 | Lombardi | ..... | 700/63 |
| 6,502,498 | B2 * | 1/2003 | Shull et al. | ..... | 91/171 |
| 6,609,315 | B1 * | 8/2003 | Hendron et al. | ..... | 37/348 |
| 6,647,718 | B2 * | 11/2003 | Stephenson | ..... | 60/403 |
| 6,763,619 | B2 * | 7/2004 | Hendron et al. | ..... | 37/348 |
| 7,530,185 | B2 | 5/2009 | Trifunovic | | |
| 8,244,438 | B2 * | 8/2012 | Koch et al. | ..... | 701/50 |
| 2006/0104786 | A1 * | 5/2006 | Shepherd et al. | ..... | 414/699 |

* cited by examiner

*Primary Examiner* — Edward Look
*Assistant Examiner* — Michael Quandt
(74) *Attorney, Agent, or Firm* — Finnegan, Henderson, Farabow, Garrett & Dunner, LLP

(57) ABSTRACT

A hydraulic system for a mobile machine is disclosed. The hydraulic system may have a first actuator, a first valve arrangement, a second actuator, and a second valve arrangement. The hydraulic system may also have at least one operator interface device movable by an operator to generate a first signal indicative of desired work tool movement in a first manner, and a second signal indicative of desired work tool movement in a second manner; and a controller configured to generate a first flow rate command directed to the first valve arrangement based on the first signal, and generate a second flow rate command directed to the second valve arrangement based on the second signal. The controller may also be configured to selectively generate a third flow rate scaled from the first flow rate command and directed to the second valve arrangement based on only the first signal.

20 Claims, 3 Drawing Sheets

HYDRAULIC SYSTEM HAVING FIXABLE MULTI-ACTUATOR RELATIONSHIP

TECHNICAL FIELD

The present disclosure relates generally to a hydraulic system, and more particularly, to a hydraulic system having a fixable multi-actuator relationship.

BACKGROUND

Machines such as wheel loaders, excavators, dozers, motor graders, and other types of heavy equipment use multiple actuators supplied with hydraulic fluid from one or more pumps on the machine to accomplish a variety of tasks. These actuators are typically velocity controlled based on, among other things, an actuation position of an operator interface device. For example, when the operator of a wheel loader pulls a joystick controller backward or pushes the joystick controller forward, one or more lift cylinders mounted on the wheel loader either extend to lift a work tool of the machine away from a ground surface or retract to lower the work tool back toward the ground surface at speeds related to the fore/aft displacement positions of the joystick controller. Similarly, when the operator pushes the same or another joystick controller to the left or right, tilt cylinders mounted on the wheel loader either extend to tilt the work tool downward toward the ground surface or retract to tilt the work tool backward away from the work surface at speeds related to the left/right displacement positions of the joystick controller.

In some machine configurations, when a work tool is lifted away from or lowered toward the ground surface, a tilt angle of the work tool relative to the ground surface naturally changes (e.g., the work tool may tilt backward toward a cab of the machine during lifting, and tilt downward toward the ground surface during lowering) due to mechanical linkage connected to the work tool, even though tilting had not been requested by the operator. In this situation, it may be possible for material within the work tool to spill over an edge of the work tool, in some cases onto the machine and/or operator of the machine. Historically, the operator of the machine was responsible for simultaneously adjusting movement of the tilt cylinder during lifting to ensure that the tilt angle of the work tool remained at a desired angle (i.e., to counteract the naturally occurring tilt of the work tool caused by lifting). This dual-control manual procedure, however, can be difficult to control and error prone.

One attempt to automatically reduce the likelihood of material spilling from a machine's work tool during lifting is disclosed in U.S. Pat. No. 7,530,185 that issued to Trifunovic on May 12, 2009 (the '185 patent). In particular, the '185 patent describes an electronic parallel lift system for a backhoe loader. The electronic parallel lift system includes a controller that causes an angle of the backhoe's tool to be automatically adjusted based on measurement of the tool's angle relative to the backhoe's frame, regardless of any particular mechanical relationship between supporting tool linkage, the backhoe's boom, and the tool. The controller uses at least one sensor to detect the angle of the tool relative to the vehicle frame, and then responsively commands a tool actuator to adjust the tool position as a function of the measured angle during boom movement.

Although the system of the '185 patent may help to reduce the likelihood of material spillage during boom lifting, it may be less than optimal. In particular, because the system of the '185 patent adjusts tool angle in a responsive manner based on only angular measurements, the tool angle must first become an angle other than desired before the controller will respond to correct the angle. This type of operation could result in sluggish and inaccurate work tool movements.

The disclosed hydraulic system is directed to overcoming one or more of the problems set forth above and/or other problems of the prior art.

SUMMARY

In one aspect, the present disclosure is directed to a hydraulic system. The hydraulic system may include a pump configured to pressurize fluid, a first actuator, and a first valve arrangement configured to meter pressurized fluid from the pump into the first actuator to move a work tool in a first manner. The hydraulic system may also include a second actuator; a second valve arrangement configured to meter pressurized fluid from the pump into the second actuator to move the work tool in a second manner; and at least one operator interface device movable by an operator to generate a first signal indicative of desired work tool movement in the first manner, and a second signal indicative of desired work tool movement in the second manner. The hydraulic system may additionally include a controller in communication with the first valve arrangement, the second valve arrangement, and the at least one operator interface device. The controller may be configured to generate a first flow rate command directed to the first valve arrangement based on the first signal, and generate a second flow rate command directed to the second valve arrangement based on the second signal. The controller may also be configured to selectively generate a third flow rate command directed to the second valve arrangement based on only the first signal. The third flow rate command may be scaled from the first flow rate command.

In another aspect, the present disclosure is directed to a method of operating a machine. The method may include receiving operator input indicative of desired work tool movement in a first manner and in a second manner, pressurizing fluid, metering pressurized fluid into a first actuator at a first flow rate based on the operator input to move the work tool in the first manner, and metering pressurized fluid into a second actuator at a second flow rate based on the operator input to move the work tool in the second manner. The method may also include selectively metering pressurized fluid into the second actuator at a third flow rate based on only the operator input to move the work tool in the first manner. The third flow rate may be scaled from the first flow rate.

DETAILED DESCRIPTION

Figure 1:
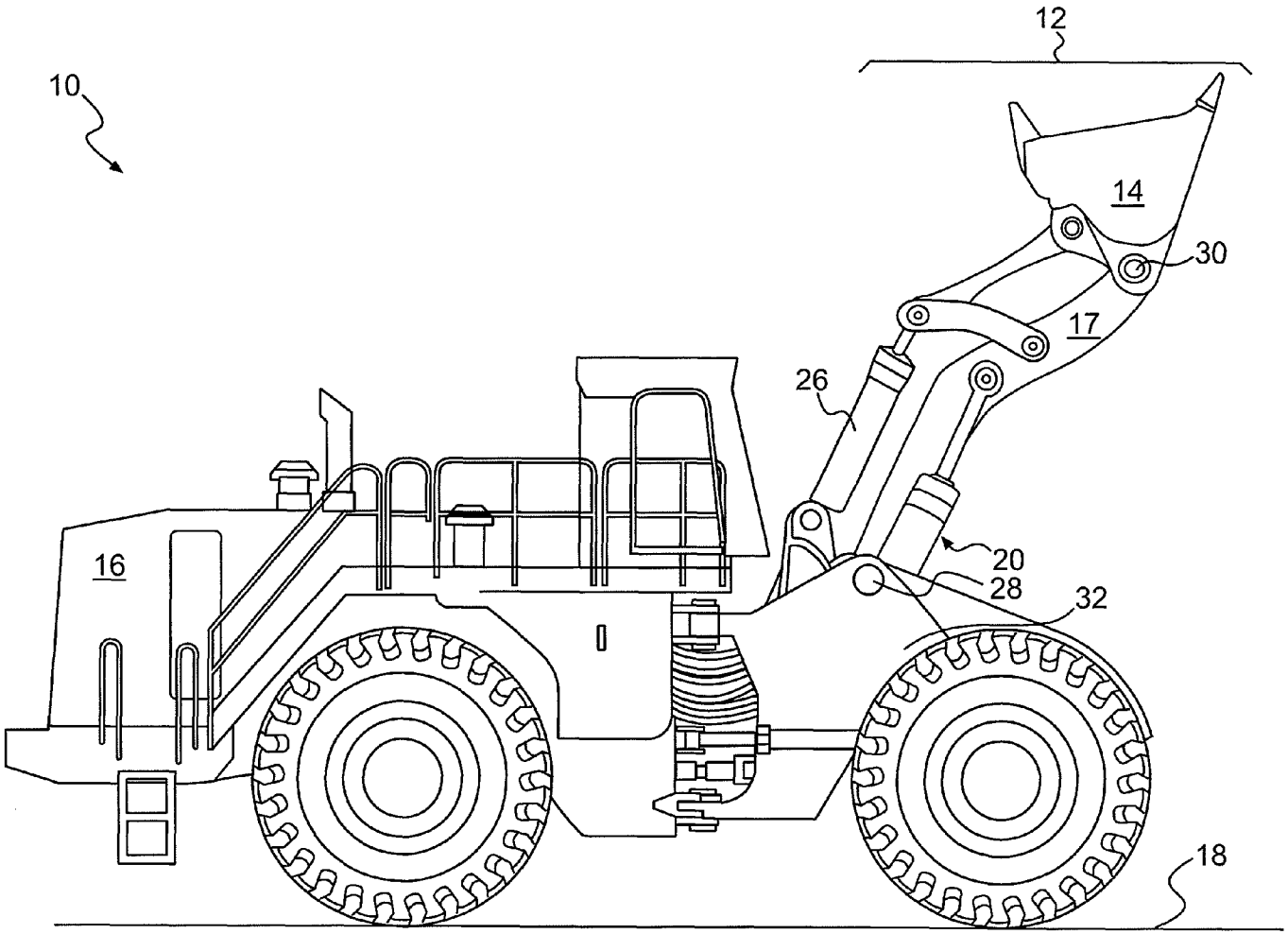
FIG. 1 is a side-view diagrammatic illustration of an exemplary disclosed machine.

FIG. 1 illustrates an exemplary machine 10 having multiple systems and components that cooperate to accomplish a task. Machine 10 may embody a fixed or mobile machine that performs some type of operation associated with an industry such as mining, construction, farming, transportation, or another industry known in the art. For example, machine 10 may be a material moving machine such as the loader depicted in FIG. 1. Alternatively, machine 10 could embody an excavator, a dozer, a backhoe, a motor grader, a dump truck, or another similar machine. Machine 10 may include, among other things, a linkage system 12 configured to move a work tool 14, and a prime mover 16 that provides power to linkage system 12.

Linkage system 12 may include structure acted on by fluid actuators to move work tool 14. Specifically, linkage system 12 may include a boom (i.e., a lifting member) 17 that is vertically pivotable about a horizontal axis 28 relative to a work surface 18 by a pair of adjacent, double-acting, hydraulic cylinders 20 (only one shown in FIG. 1). Linkage system 12 may also include a single, double-acting, hydraulic cylinder 26 connected to tilt work tool 14 relative to boom 17 in a vertical direction about a horizontal axis 30. Boom 17 may be pivotably connected at one end to a body 32 of machine 10, while work tool 14 may be pivotably connected to an opposing end of boom 17. It should be noted that alternative linkage configurations may also be possible.

Numerous different work tools 14 may be attachable to a single machine 10 and controlled to perform a particular task. For example, work tool 14 could embody a bucket (shown in FIG. 1), a fork arrangement, a blade, a shovel, a ripper, a dump bed, a broom, a snow blower, a propelling device, a cutting device, a grasping device, or another task-performing device known in the art. Although connected in the embodiment of FIG. 1 to lift and tilt relative to machine 10, work tool 14 may alternatively or additionally pivot, rotate, slide, swing, or move in any other appropriate manner.

Prime mover 16 may embody an engine such as, for example, a diesel engine, a gasoline engine, a gaseous fuel-powered engine, or another type of combustion engine known in the art that is supported by body 32 of machine 10 and operable to power the movements of machine 10 and work tool 14. It is contemplated that prime mover may alternatively embody a non-combustion source of power, if desired, such as a fuel cell, a power storage device (e.g., a battery), or another source known in the art. Prime mover 16 may produce a mechanical or electrical power output that may then be converted to hydraulic power for moving hydraulic cylinders 20 and 26.

Figure 2:
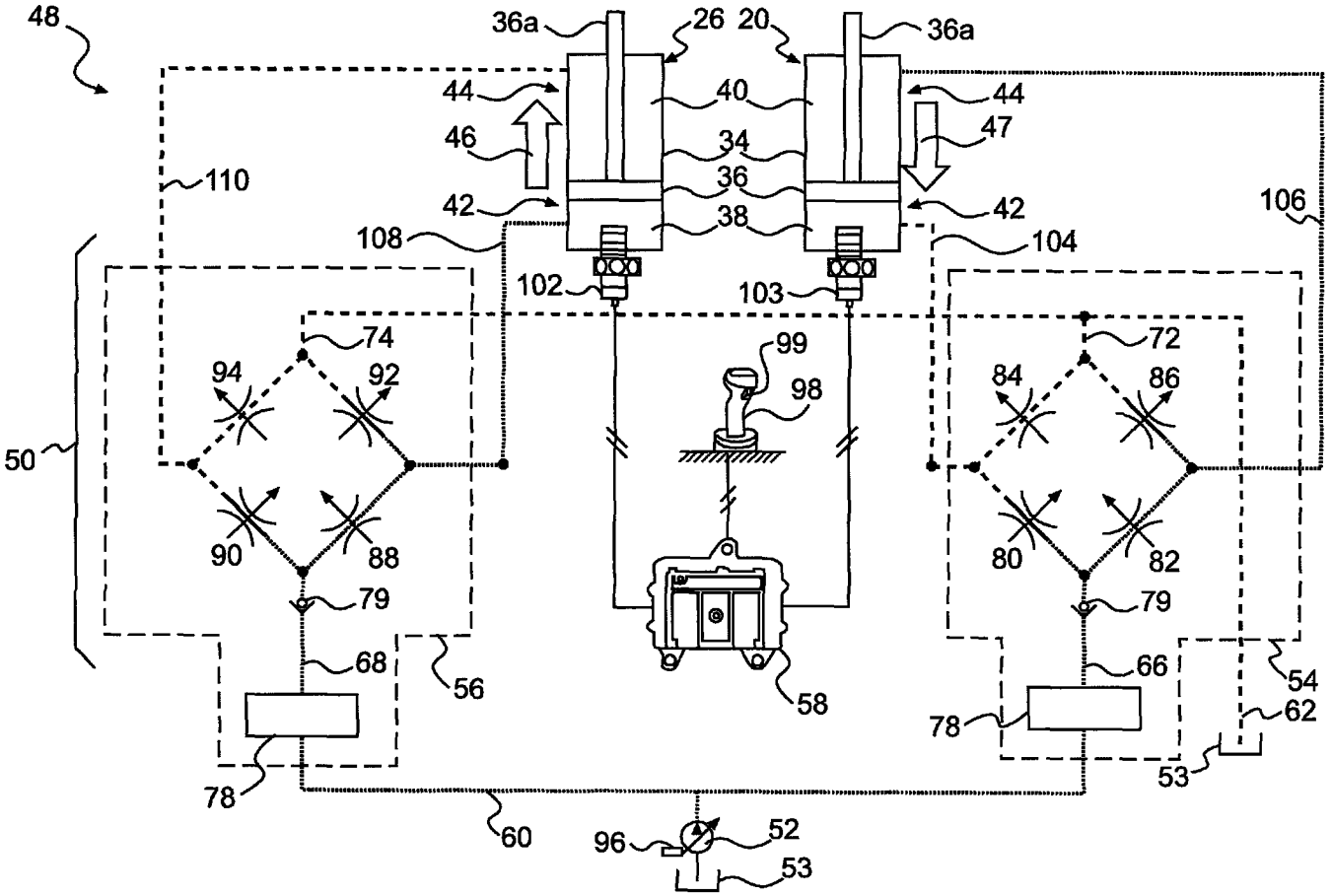
FIG. 2 is a schematic illustration of an exemplary disclosed hydraulic system that may be used in conjunction with the machine of FIG. 1.

For purposes of simplicity, FIG. 2 illustrates the composition and connections of only hydraulic cylinder 26 and one of hydraulic cylinders 20. It should be noted, however, that machine 10 may include other hydraulic actuators of similar composition connected to move the same or other structural members of linkage system 12 in a similar manner, if desired.

As shown in FIG. 2, each of hydraulic cylinders 20 and 26 may include a tube 34 and a piston assembly 36 arranged within tube 34 to form a first chamber 38 and a second chamber 40. In one example, a rod portion 36*a* of piston assembly 36 may extend through an end of second chamber 40. As such, second chamber 40 may be associated with a rod-end 44 of its respective cylinder, while first chamber 38 may be associated with an opposing head-end 42 of its respective cylinder.

First and second chambers 38, 40 may each be selectively supplied with pressurized fluid and drained of the pressurized fluid to cause piston assembly 36 to displace within tube 34, thereby changing an effective length of hydraulic cylinders 20, 26 and moving work tool 14 (referring to FIG. 1). A flow rate of fluid into and out of first and second chambers 38, 40 may relate to a velocity of hydraulic cylinders 20, 26 and work took 14, while a pressure differential between first and second chambers 38, 40 may relate to a force imparted by hydraulic cylinders 20, 26 on work tool 14. An expansion (represented by an arrow 46) and a retraction (represented by an arrow 47) of hydraulic cylinders 20, 26 may function to assist in moving work tool 14 in different manners (e.g., lifting and tilting work tool 14, respectively).

To help regulate filling and draining of first and second chambers 38, 40, machine 10 may include a hydraulic control system 48 having a plurality of interconnecting and cooperating fluid components. Hydraulic control system 48 may include, among other things, a valve stack 50 at least partially forming a circuit between hydraulic cylinders 20, 26, an engine-driven pump 52, and a tank 53. Valve stack 50 may include a lift valve arrangement 54, a tilt valve arrangement 56, and, in some embodiments, one or more auxiliary valve arrangements (not shown) that are fluidly connected to receive and discharge pressurized fluid in parallel fashion. In one example, valve arrangements 54, 56 may include separate bodies bolted to each other to form valve stack 50. In another embodiment, each of valve arrangements 54, 56 may be stand-alone arrangements, connected to each other only by way of external fluid conduits (not shown). It is contemplated that a greater number, a lesser number, or a different configuration of valve arrangements may be included within valve stack 50, if desired. For example, a swing valve arrangement (not shown) configured to control a swinging motion of linkage system 12, one or more travel valve arrangements, and other suitable valve arrangements may be included within valve stack 50. Hydraulic control system 48 may further include a controller 58 in communication with prime mover 16 and with valve arrangements 54, 56 to control corresponding movements of hydraulic cylinders 20, 26.

Each of lift and tilt valve arrangements 54, 56 may regulate the motion of their associated fluid actuators. Specifically, lift valve arrangement 54 may have elements movable to simultaneously control the motions of both of hydraulic cylinders 20 and thereby lift boom 17 relative to work surface 18. Likewise, tilt valve arrangement 56 may have elements movable to control the motion of hydraulic cylinder 26 and thereby tilt work tool 14 relative to boom 17.

Valve arrangements 54, 56 may be connected to regulate separate flows of pressurized fluid to and from hydraulic cylinders 20, 26 via common passages. Specifically, valve arrangements 54, 56 may be connected to pump 52 by way of a common supply passage 60, and to tank 53 by way of a common drain passage 62. Lift and tilt valve arrangements 54, 56 may be connected in parallel to common supply passage 60 by way of individual fluid passages 66 and 68, respectively, and in parallel to common drain passage 62 by way of individual fluid passages 72 and 74, respectively. A pressure compensating valve 78 and/or a check valve 79 may be disposed within each of fluid passages 66, 68 to provide a unidirectional supply of fluid having a substantially constant flow to valve arrangements 54, 56. Pressure compensating valves 78 may be pre- (shown in FIG. 2) or post-compensating (not shown) valves movable, in response to a differential pressure, between a flow passing position and a flow blocking position such that a substantially constant flow of fluid is provided to valve arrangements 54 and 56, even when a pressure of the fluid directed to pressure compensating valves 78 varies. It is contemplated that, in some applications, pressure compensating valves 78 and/or check valves 79 may be omitted, if desired.

Each of lift and tilt valve arrangements 54, 56 may be substantially identical and include four independent metering valves (IMVs). Of the four IMVs, two may be generally associated with fluid supply functions, while two may be generally associated with drain functions. For example, lift valve arrangement 54 may include a head-end supply valve 80, a rod-end supply valve 82, a head-end drain valve 84, and a rod-end drain valve 86. Similarly, tilt valve arrangement 56 may include a head-end supply valve 88, a rod-end supply valve 90, a head-end drain valve 92, and a rod-end drain valve 94.

Head-end supply valve 80 may be disposed between fluid passage 66 and a fluid passage 104 that leads to first chamber 38 of hydraulic cylinder 20, and be configured to regulate a flow rate of pressurized fluid into first chamber 38 in response to a flow command from controller 58. Head-end supply valve 80 may include a variable-position, spring-biased valve element, for example a poppet or spool element, that is solenoid actuated and configured to move to any position between a first end-position at which fluid is allowed to flow into first chamber 38, and a second end-position at which fluid flow is blocked from first chamber 38. It is contemplated that head-end supply valve 80 may also be configured to allow fluid from first chamber 38 to flow through head-end supply valve 80 during a regeneration event when a pressure within first chamber 38 exceeds a pressure of pump 52 and/or a pressure of the chamber receiving the regenerated fluid. It is further contemplated that head-end supply valve 80 may include additional or different elements than described above such as, for example, a fixed-position valve element or any other valve element known in the art. It is also contemplated that head-end supply valve 80 may alternatively be hydraulically actuated, mechanically actuated, pneumatically actuated, or actuated in another suitable manner.

Rod-end supply valve 82 may be disposed between fluid passage 66 and a fluid passage 106 leading to second chamber 40 of hydraulic cylinder 20, and be configured to regulate a flow rate of pressurized fluid into second chamber 40 in response to a flow command from controller 58. Rod-end supply valve 82 may include a variable-position, spring-biased valve element, for example a poppet or spool element, that is solenoid actuated and configured to move to any position between a first end-position at which fluid is allowed to flow into second chamber 40, and a second end-position at which fluid is blocked from second chamber 40. It is contemplated that rod-end supply valve 82 may also be configured to allow fluid from second chamber 40 to flow through rod-end supply valve 82 during a regeneration event when a pressure within second chamber 40 exceeds a pressure of pump 52 and/or a pressure of the chamber receiving the regenerated fluid. It is further contemplated that rod-end supply valve 82 may include additional or different valve elements such as, for example, a fixed-position valve element or any other valve element known in the art. It is also contemplated that rod-end supply valve 82 may alternatively be hydraulically actuated, mechanically actuated, pneumatically actuated, or actuated in another suitable manner.

Head-end drain valve 84 may be disposed between fluid passage 104 and fluid passage 72, and be configured to regulate a flow rate of pressurized fluid from first chamber 38 of hydraulic cylinder 20 to tank 53 in response to a flow command from controller 58. Head-end drain valve 84 may include a variable-position, spring-biased valve element, for example a poppet or spool element, that is solenoid actuated and configured to move to any position between a first end-position at which fluid is allowed to flow from first chamber 38, and a second end-position at which fluid is blocked from flowing from first chamber 38. It is contemplated that head-end drain valve 84 may include additional or different valve elements such as, for example, a fixed-position valve element or any other valve element known in the art. It is also contemplated that head-end drain valve 84 may alternatively be hydraulically actuated, mechanically actuated, pneumatically actuated, or actuated in another suitable manner.

Rod-end drain valve 86 may be disposed between fluid passage 106 and fluid passage 72, and be configured to regulate a flow rate of pressurized fluid from second chamber 40 of hydraulic cylinder 20 to tank 53 in response to a flow command from controller 58. Rod-end drain valve 86 may include a variable-position, spring-biased valve element, for example a poppet or spool element, that is solenoid actuated and configured to move to any position between a first end-position at which fluid is allowed to flow from second chamber 40, and a second end-position at which fluid is blocked from flowing from second chamber 40. It is contemplated that rod-end drain valve 86 may include additional or different valve elements such as, for example, a fixed-position valve element or any other valve element known in the art. It is also contemplated that rod-end drain valve 86 may alternatively be hydraulically actuated, mechanically actuated, pneumatically actuated, or actuated in another suitable manner.

Head-end supply valve 88 may be disposed between fluid passage 68 and a fluid passage 108 that leads to first chamber 38 of hydraulic cylinder 26, and be configured to regulate a flow rate of pressurized fluid into first chamber 38 in response to a flow command from controller 58. Head-end supply valve 88 may include a variable-position, spring-biased valve element, for example a poppet or spool element, that is solenoid actuated and configured to move to any position between a first end-position at which fluid is allowed to flow into first chamber 38, and a second end-position at which fluid flow is blocked from first chamber 38. It is contemplated that head-end supply valve 88 may be also configured to allow fluid from first chamber 38 to flow through head-end supply valve 88 during a regeneration event when a pressure within first chamber 38 exceeds a pressure of pump 52 and/or a pressure of the chamber receiving the regenerated fluid. It is further contemplated that head-end supply valve 88 may include additional or different elements such as, for example, a fixed-position valve element or any other valve element known in the art. It is also contemplated that head-end supply valve 88 may alternatively be hydraulically actuated, mechanically actuated, pneumatically actuated, or actuated in another suitable manner.

Rod-end supply valve 90 may be disposed between fluid passage 68 and a fluid passage 110 that leads to second chamber 40 of hydraulic cylinder 26, and be configured to regulate a flow rate of pressurized fluid into second chamber 40 in response to a flow command from controller 58. Specifically, rod-end supply valve 90 may include a variable-position, spring-biased valve element, for example a poppet or spool element, that is solenoid actuated and configured to move to any position between a first end-position, at which fluid is allowed to flow into second chamber 40, and a second end-position, at which fluid is blocked from second chamber 40. It is contemplated that rod-end supply valve 90 may also be configured to allow fluid from second chamber 40 to flow through rod-end supply valve 90 during a regeneration event when a pressure within second chamber 40 exceeds a pressure of pump 52 and/or a pressure of the chamber receiving the regenerated fluid. It is further contemplated that rod-end supply valve 90 may include additional or different valve elements such as, for example, a fixed-position valve element or any other valve element known in the art. It is also contemplated that rod-end supply valve 90 may alternatively be hydraulically actuated, mechanically actuated, pneumatically actuated, or actuated in another suitable manner.

Head-end drain valve 92 may be disposed between fluid passage 108 and fluid passage 74, and be configured to regulate a flow rate of pressurized fluid from first chamber 38 of hydraulic cylinder 26 to tank 53 in response to a flow command from controller 58. Specifically, head-end drain valve 92 may include a variable-position, spring-biased valve element, for example a poppet or spool element, that is solenoid actuated and configured to move to any position between a first end-position at which fluid is allowed to flow from first chamber 38, and a second end-position at which fluid is blocked from flowing from first chamber 38. It is contemplated that head-end drain valve 92 may include additional or different valve elements such as, for example, a fixed-position valve element or any other valve element known in the art. It is also contemplated that head-end drain valve 92 may alternatively be hydraulically actuated, mechanically actuated, pneumatically actuated, or actuated in another suitable manner.

Rod-end drain valve 94 may be disposed between fluid passage 110 and fluid passage 74, and be configured to regulate a flow rate of pressurized fluid from second chamber 40 of hydraulic cylinder 26 to tank 53 in response to a flow command from controller 58. Rod-end drain valve 94 may include a variable-position, spring-biased valve element, for example a poppet or spool element, that is solenoid actuated and configured to move to any position between a first end-position at which fluid is allowed to flow from second chamber 40, and a second end-position at which fluid is blocked from flowing from second chamber 40. It is contemplated that rod-end drain valve 94 may include additional or different valve element such as, for example, a fixed-position valve element or any other valve elements known in the art. It is also contemplated that rod-end drain valve 94 may alternatively be hydraulically actuated, mechanically actuated, pneumatically actuated, or actuated in another suitable manner.

Pump 52 may have variable displacement and be load-sense controlled to draw fluid from tank 53 and discharge the fluid at a specified elevated pressure to valve arrangements 54, 56. That is, pump 52 may include a stroke-adjusting mechanism 96, for example a swashplate or spill valve, a position of which is hydro-mechanically adjusted based on a sensed load of hydraulic control system 48 to thereby vary an output (e.g., a discharge rate) of pump 52. The displacement of pump 52 may be adjusted from a zero displacement position at which substantially no fluid is discharged from pump 52, to a maximum displacement position at which fluid is discharged from pump 52 at a maximum rate. In one embodiment, a load-sense passage (not shown) may direct a pressure signal to stroke-adjusting mechanism 96 and, based on a value of that signal (i.e., based on a pressure of signal fluid within the passage), the position of stroke-adjusting mechanism 96 may change to either increase or decrease the output of pump 52 and thereby maintain the specified pressure. Pump 52 may be drivably connected to prime mover 16 of machine 10 by, for example, a countershaft, a belt, or in another suitable manner. Alternatively, pump 52 may be indirectly connected to prime mover 16 via a torque converter, a gear box, an electrical circuit, or in any other manner known in the art.

Tank 53 may constitute a reservoir configured to hold a supply of fluid. The fluid may include, for example, a dedicated hydraulic oil, an engine lubrication oil, a transmission lubrication oil, or any other fluid known in the art. One or more hydraulic circuits within machine 10 may draw fluid from and return fluid to tank 53. It is also contemplated that hydraulic control system 48 may be connected to multiple separate fluid tanks, if desired.

Controller 58 may embody a single microprocessor or multiple microprocessors that include components for controlling valve arrangements 54, 56 based on, among other things, input from an operator of machine 10 and/or one or more sensed operational parameters. Numerous commercially available microprocessors can be configured to perform the functions of controller 58. It should be appreciated that controller 58 could readily be embodied in a general machine microprocessor capable of controlling numerous machine functions. Controller 58 may include a memory, a secondary storage device, a processor, and any other components for running an application. Various other circuits may be associated with controller 58 such as power supply circuitry, signal conditioning circuitry, solenoid driver circuitry, and other types of circuitry.

Controller 58 may receive operator input associated with a desired movement of machine 10 by way of one or more interface devices 98 that are located within an operator station of machine 10. Interface devices 98 may embody, for example, single or multi-axis joysticks, levers, or other known interface devices located proximate an onboard operator seat (if machine 10 is directly controlled by an onboard operator) or located within a remote station offboard machine 10. Each interface device 98 may be a proportional-type device that is movable through a range from a neutral position to a maximum displaced position to generate a corresponding displacement signal that is indicative of a desired velocity of work tool 14 caused by hydraulic cylinders 20, 26, for example desired lifting and tilting velocities of work tool 14. The desired lifting and tilting velocity signals may be generated independently or simultaneously by the same or different interface devices 98, and be directed to controller 58 for further processing.

In some embodiments, a mode button 99 or other similar activating component may associated with interface devices 98 and utilized by the operator of machine 10 to initiate machine operation in a particular mode. For example, mode button 99 may be located on the same operator interface device 98 utilized to request particular lift and/or tilt velocities, and be selectively activated by the operator to implement a mode of operation that fixes a relationship between work tool lifting and tilting so as to alleviate tilt adjusting required by the operator during lifting. The fixed relationship mode may function to maintain a particular angle of work tool 14 relative to work surface 18 during lifting, without the operator being required to simultaneously correct the naturally occurring work tool tilt. The same or another button associated with interface devices 98 may be utilized by the operator to set the particular angle maintained during the fixed relationship mode of operation. For example, the operator may move work tool 14 to a desired orientation, and then activate mode button 99 to indicate the current orientation is the desired orientation. The fixed-relationship mode of operation will be described in more detail in the following section.

One or more maps relating the interface device signals, the corresponding desired work tool velocities, associated flow rates, valve element positions, system pressures, modes of operation, and/or other characteristics of hydraulic control system 48 may be stored in the memory of controller 58. Each of these maps may be in the form of tables, graphs, and/or equations. Controller 58 may be configured to allow the operator to directly modify these maps and/or to select specific maps from available relationship maps stored in the memory of controller 58 to affect actuation of hydraulic cylinders 20, 26. It is also contemplated that the maps may be automatically selected for use by controller 58 based on sensed or determined modes of machine operation, if desired.

Controller 58 may be configured to receive input from interface device 98 and to command operation of valve arrangements 54, 56 in response to the input and based on the relationship maps described above. Specifically, controller 58 may receive the interface device signals indicative of a desired work tool lift/tilt velocities and mode of operation, and reference the selected and/or modified relationship maps stored in the memory of controller 58 to determine desired flow rates for the appropriate supply and/or drain elements within valve arrangements 54, 56. The desired flow rates can then be commanded of the appropriate supply and drain elements to cause filling of particular chambers within hydraulic cylinders 20, 26 at rates that correspond with the desired work tool velocities in the selected operational mode.

Controller 58 may rely, at least in part, on feedback from one or more sensors during implementation of the fixed relationship mode of operation. The feedback may include, for example, measurement information regarding the orientation of work tool 14 relative to work surface 18. In the disclosed embodiment, the orientation information is provided by way of position sensors 102, 103 associated with each of hydraulic cylinders 20, 26. Sensors 102, 103 may each embody a magnetic pickup-type sensor associated with a magnet (not shown) embedded within the piston assembly 36 of different hydraulic cylinders 20, 26. In this configuration, sensors 102, 103 may each be configured to detect an extension position of the corresponding hydraulic cylinder 20, 26 by monitoring the relative location of the magnet, and generate corresponding position signals directed to controller 58 for further processing. It is contemplated that sensors 102, 103 may alternatively embody other types of sensors such as, for example, magnetostrictive-type sensors associated with a wave guide (not shown) internal to hydraulic cylinders 20, 26, cable type sensors associated with cables (not shown) externally mounted to hydraulic cylinders 20, 26, internally- or externally-mounted optical sensors, rotary style sensors associated with a joint pivotable by hydraulic cylinders 20, 26, or any other type of sensors known in the art. From the position signals generated by sensors 102, 103 and based on known geometry and/or kinematics of hydraulic cylinders 20, 26 and linkage system 12, controller 58 may be configured to calculate the orientation of work tool 14 relative to body 32 and/or work surface 18. This feedback information may then be utilized by controller 58 during implementation of the fixed relationship mode of operation, as will be described in more detail below.

Figure 3:
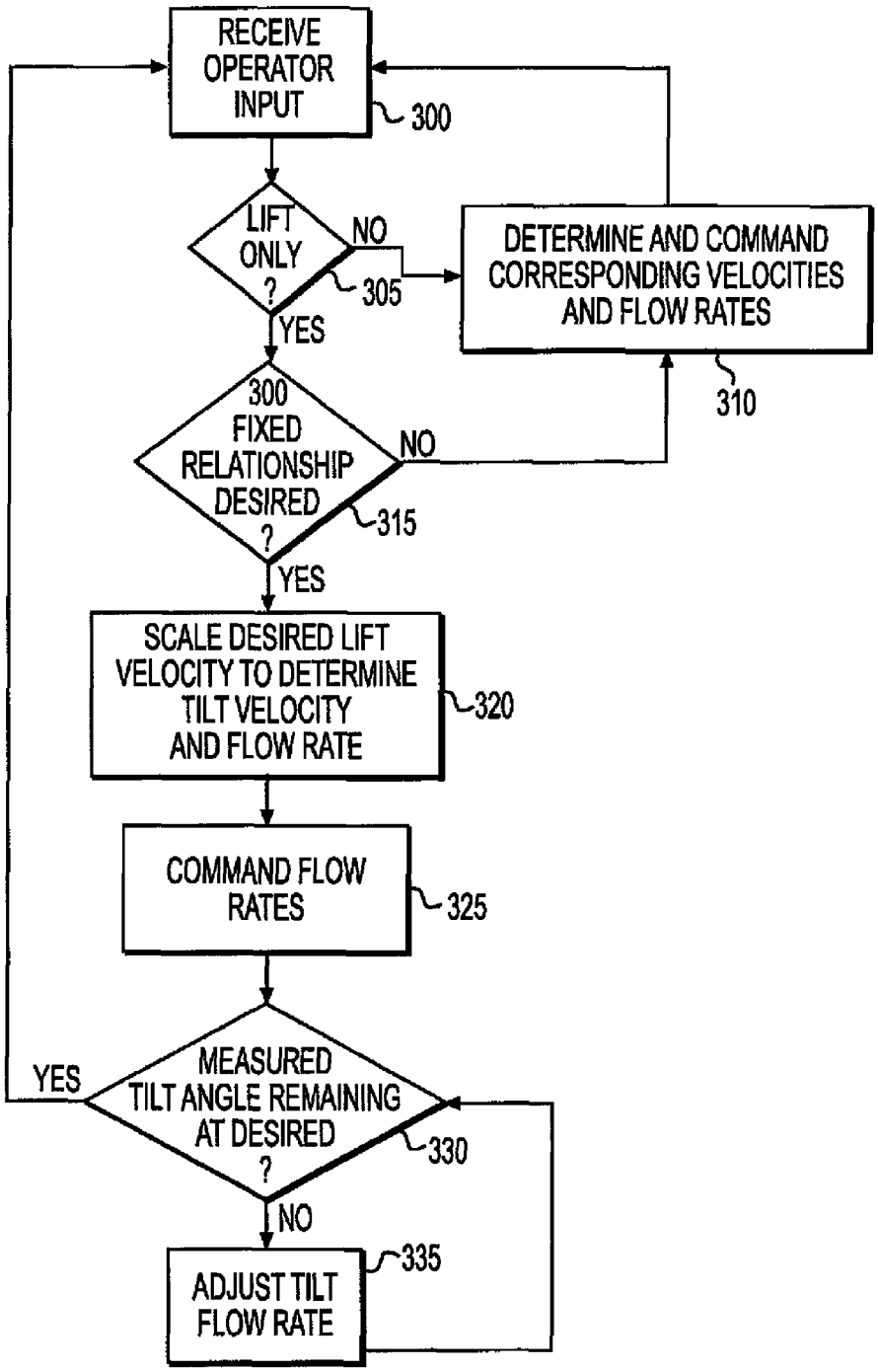
FIG. 3 is a flow chart illustrating an exemplary disclosed method performed by the hydraulic system of FIG. 2.

FIG. 3 illustrates an exemplary operation performed by controller 58. FIG. 3 will be discussed in more detail in the following section to further illustrate the disclosed concepts.

INDUSTRIAL APPLICABILITY

The disclosed hydraulic control system may be applicable to any machine having a work tool where it is desirable to maintain a specific orientation of the work tool during lifting of the work tool. The disclosed hydraulic control system may be used to selectively implement a fixed relationship mode of operation that provides the ability to maintain the work tool orientation with little or no operator intervention. Operation of hydraulic control system 48 will now be explained.

During operation of machine 10, a machine operator may manipulate interface device 98 to request corresponding lifting and tilting movements of work tool 14. For example, the operator may move interface device 98 in the fore/aft direction to request lifting of work tool 14, and in the left/right direction to request tilting of work tool 14. The displacement positions of interface device 98 may be related to operator desired lift and tilt velocities of work tool 14. Interface device 98 may generate first and second position signals indicative of the operator desired lift and tilt velocities of work tool 14 during manipulation, and direct these position signals to controller 58 for further processing. In addition, the operator may choose to activate the fixed relationship mode of operation and/or specify a desired work tool orientation (i.e., angle relative to body 32 and/or work surface 18) by way of mode button 99. A third signal indicative of the desire to activate the fixed relationship mode and/or indicative of the specific work tool angle to be maintained during lifting may be generated by mode button 99 and directed to controller 58 for further processing.

Controller 58 may receive the operator interface device position signals regarding the desired work tool velocities, mode activation, and/or the specific work tool angle (Step 300), and determine if only lifting has been requested by the operator (Step 305). If lifting and tilting together or only tilting has been requested (Step 305: No), the fixed relationship mode of operation may not be possible, and controller 58 may determine and command the corresponding flow rates in a conventional manner (Step 310) that result in the operator desired work tool velocities.

However, if at Step 305, controller 58 determines that only lifting has been requested by the operator (Step 305: Yes) (i.e., that the tilt signal is non-existent), controller 58 may then determine if the operator also requested machine operation in the fixed relationship mode (Step 315) (i.e., if mode button 99 has been activated). If at Step 315, controller 58 determines that the fixed relationship mode has not been activated (Step 3150: No), control may return to Step 310, where the corresponding desired lift velocity and flow rate are determined and commanded in the conventional manner. Conversely, if at Step 315, controller 58 determines that the fixed relationship mode of operation has been selected (Step 315: Yes), controller 58 may determine a tilt velocity and corresponding tilt flow rate related to the desired lift velocity and lift flow rate that may be necessary to maintain during lifting the desired orientation (i.e., the specific angle) of work tool 14 received from the operator in Step 300 (Step 320). That is, during the fixed relationship mode of operation, controller 58 may be configured to determine a tilt velocity and corresponding tilt flow rate based on only the desired lift velocity signal, even when a tilting movement of work tool 14 has not been directly requested by the operator. This tilt velocity and flow rate may account for the naturally occurring changes in work tool orientation (i.e., undesired work tool tilting) caused by implementing the operator-requested work tool lifting.

In the disclosed embodiment, the tilt velocity and corresponding tilt flow rate determined in Step 320 may be determined as a scaled down ratio of the operator desired lift velocity and corresponding lift flow rate. Specifically, when no tilting movement of work tool 14 has been requested by the operator, the tilt flow rate commanded of valve arrangement 56 may be a scaled down ratio of the lift flow rate command directed to valve arrangement 54. The specific ratio may be machine, work tool, and/or linkage system dependent, and based on known kinematics. That is, for a given machine/tool/linkage configuration, the way that the orientation of a particular machine's work tool 14 naturally changes during lifting may be known. Accordingly, the lift-to-tilt ratio may be calculated based on the known kinematics such that the orientation of work tool 14 remains about the same (i.e., at the operator-specified angle) during lifting of work tool 14. This ratio may be provided to controller 58 in the form of a factor value, an equation, an algorithm, and/or a map, which controller 58 may then utilize to determine a scaled down tilt flow rate for any given lift flow rate. After determining the lift and scaled down tilt flow rates that should result in the desired lift velocity and fixed orientation of work tool 14 at the desired angle, controller 58 may direct the flow rate commands to the corresponding vale arrangements 54, 56 (Step 325).

Because of machine-to-machine variation, machine aging and wear, machine damage, and other factors over which controller 58 may have little influence, it may be possible for orientation error to occur during the fixed relationship mode of operation. That is, it may be possible that the scaled down tilt flow rate may not always successfully maintain work tool 14 in the desired orientation during lifting. Accordingly, controller 58 may utilize feedback from sensors 102, 103 to account for and/or correct the error. Specifically, controller 58 may continuously or selectively compare a measured orientation of work tool 14 to the desired orientation and determine if the scale down ratio is successfully maintaining work tool 14 at the desired orientation during operator-requested lifting (Step 330). If the scale down ratio and associated tilt flow rate are not successfully maintaining the desired work tool orientation during lifting (Step 330: No), controller 58 may be configured to selectively adjust the ratio and tilt flow rate accordingly (Step 335). Control may loop through Steps 330 and 350 until the orientation error has been sufficiently reduced. In some embodiments, controller 58 may also be configured to make incremental adjustments to the ratio over time that can be saved and utilized in future fixed relationship operations each time the comparison of Step 330 is completed and errors are determined, to thereby improve future orientation accuracies, if desired. After successful completion of Step 335, control may return to Step 300.

The disclosed hydraulic control system 48 may provide for a responsive and accurate way to maintain a desired work tool angle during a lifting operation. In particular, because a desired lift velocity and/or corresponding lift flow rate may be scaled down to produce a tilt velocity and/or corresponding tilt flow rate that should maintain the desired orientation, hydraulic control system 48 may be proactive and not need to first experience an undesired orientation before changing adjusting the orientation of work tool 14. This functionality may help to improve accuracy in the orientation of work tool 14, as well as responsiveness. In fact, because the hydraulic control system 48 may have the ability to adjust the ratio used during the scaling, accuracy in the orientation may be enhanced even further over time.

It will be apparent to those skilled in the art that various modifications and variations can be made to the disclosed hydraulic system. Other embodiments will be apparent to those skilled in the art from consideration of the specification and practice of the disclosed hydraulic system. For example, it is contemplated that mode button 99 may be omitted, if desired, and the fixed relationship mode of operation automatically initiated any time that only lift is requested by the operator of machine 10. It is intended that the specification and examples be considered as exemplary only, with a true scope being indicated by the following claims and their equivalents.

What is claimed is:

1. A hydraulic system, comprising:

a pump configured to pressurize fluid;

a first actuator;

a first valve arrangement configured to meter pressurized fluid from the pump into the first actuator to move a work tool in a first manner;

a second actuator;

a second valve arrangement configured to meter pressurized fluid from the pump into the second actuator to move the work tool in a second manner;

at least one operator interface device movable by an operator to generate a first signal indicative of desired work tool movement in the first manner, and a second signal indicative of desired work tool movement in the second manner; and a controller in communication with the first valve arrangement, the second valve arrangement, and the at least one operator interface device, the controller being configured to:

generate a first flow rate command directed to the first valve arrangement based on the first signal, the first flow rate command specifying a first flow rate corresponding to the first signal;

generate a second flow rate command directed to the second valve arrangement based on the second signal; and generate a third flow rate command directed to the second valve arrangement based on the first signal, the third flow rate command specifying a third flow rate obtained by scaling down the first flow rate.

2. The hydraulic system of claim 1, wherein the third flow rate command is generated only when the second signal is nonexistent.

3. The hydraulic system of claim 2, wherein the third flow rate command is scaled down from the first flow rate command by a factor associated with a known kinematic relationship between movements in the first and second manners.

4. The hydraulic system of claim 3, wherein the third flow rate command is sufficient to maintain the work tool at a particular angle relative to a ground surface during movement in the first manner.

5. The hydraulic system of claim 4, wherein the at least one operator interface device is movable by the operator to activate a mode of operation associated with maintaining the work tool at the particular angle.

6. The hydraulic system of claim 4, wherein the at least one operator interface device is movable by the operator to generate a third signal indicative of the particular angle that is directed to the controller.

7. The hydraulic system of claim 4, further including at least one sensor configured to generate a third signal indicative of an actual angle of the work tool relative to the ground surface, wherein the controller is configured to selectively adjust the third flow rate command based on the third signal.

8. The hydraulic system of claim 7, wherein:

the work tool is operatively connected to a machine body by at least one linkage member;

the first actuator is a lift cylinder configured to lift the at least one linkage member relative to the machine body; and the second actuator is a tilt cylinder configured to tilt the work tool relative to the at least one linkage member.

9. The hydraulic system of claim 8, wherein the at least one sensor includes:

a first position sensor associated with the lift cylinder; and a second position sensor associated with the tilt cylinder.

10. A method of operating a machine, comprising:

receiving operator input indicative of desired work tool movement in a first manner and in a second manner;

pressurizing fluid;

metering pressurized fluid into a first actuator at a first flow rate based on the operator input to move the work tool in the first manner;

metering pressurized fluid into a second actuator at a second flow rate based on the operator input to move the work tool in the second manner;

metering pressurized fluid into the second actuator at a third flow rate based on the operator input to move the work tool in the first manner, the third flow rate being determined by scaling down the first flow rate.

11. The method of claim 10, wherein the third flow rate is metered only when the operator input to move the work tool in the second manner is nonexistent.

12. The method of claim 11, wherein the third flow rate is scaled down from the first flow rate by a factor associated with a known kinematic relationship between movements in the first and second manners.

13. The method of claim 12, wherein the third flow rate is sufficient to maintain the work tool at a particular angle relative to a ground surface during movement in the first manner.

14. The method of claim 13, further including receiving operator input indicative of desired activation of a mode of operation associated with maintaining the work tool at the particular angle.

15. The method of claim 13, further including receiving operator input indicative of the particular angle.

16. The method of claim 13, further including:

sensing an actual angle of the work tool relative to the ground surface; and selectively adjusting the third flow rate based on a difference between the actual angle and the particular angle.

17. The method of claim 16, wherein:

the work tool is operatively connected to a machine body by at least one linkage member;

the first actuator is a lift cylinder configured to lift the at least one linkage member relative to the machine body; and the second actuator is a tilt cylinder configured to tilt the work tool relative to the at least one linkage member.

18. The method of claim 17, wherein sensing the actual angle includes:

sensing a position of the lift cylinder;

sensing a position of the tilt cylinder; and calculating the actual angle based on sensed positions of the lift and tilt cylinders.

19. A machine, comprising:

a prime mover;

a body configured to support the prime mover;

a pump driven by the prime mover to pressurize fluid;

a work tool;

at least one linkage member operatively connecting the work tool to the body;

a lift cylinder operatively connected between the body and the at least one linkage member;

a lift valve arrangement configured to meter pressurized fluid from the pump into the lift cylinder to lift the work tool relative to the body;

a tilt cylinder operatively connected between the at least one linkage member and the work tool;

a tilt valve arrangement configured to meter pressurized fluid from the pump into the tilt cylinder to tilt the work tool relative to the at least one linkage member;

at least one operator interface device configured generate a first signal indicative of a desired lifting of the work tool, and a second signal indicative of desired tilting of the work tool;

at least one sensor configured to generate a third signal indicative of an actual angle of the work tool relative to the body; and a controller in communication with the first valve arrangement, the second valve arrangement, the at least one operator interface device, and the at least one sensor, the controller being configured to:

generate a first flow rate command directed to the lift valve arrangement based on the first signal, the first flow rate command specifying a first flow rate corresponding to the first signal;

generate a second flow rate command directed to the tilt valve arrangement based on the second signal; and generate a third flow rate command directed to the tilt valve arrangement based on the first signal, the third flow rate command specifying a third flow rate and being sufficient to maintain the work tool at a particular angle relative to a ground surface during lifting movements the third flow rate being determined by scaling down the first flow rate by a factor associated with a known kinematic relationship between lifting and tilting movements of the work tool, wherein the third flow rate command is generated only when the second signal is nonexistent.

20. The machine of claim 19, wherein the at least one operator interface device is movable by the operator to generate a fourth signal indicative of at least one of:

an operators desired to activate a mode of operation associated with maintaining the work tool at the particular angle; and the particular angle that is directed to the controller.

* * * * *